US008845033B2

(12) United States Patent
Brenken

(10) Patent No.: US 8,845,033 B2
(45) Date of Patent: Sep. 30, 2014

(54) METHOD FOR THE AUTOMATIC PRODUCTION OF A SEGMENT BRUSH AND ACCESSORY FOR CARRYING OUT THE METHOD

(75) Inventor: Rudolf Brenken, Bueren (DE)

(73) Assignee: Woehler Brusch Tech GmbH, Bad Wuenneberg (DE)

( * ) Notice: Subject to any disclaimer, the term of this patent is extended or adjusted under 35 U.S.C. 154(b) by 380 days.

(21) Appl. No.: 13/254,521

(22) PCT Filed: Jan. 26, 2010

(86) PCT No.: PCT/DE2010/000072

§ 371 (c)(1),
(2), (4) Date: Nov. 21, 2011

(87) PCT Pub. No.: WO2010/099769

PCT Pub. Date: Sep. 10, 2010

(65) Prior Publication Data

US 2012/0074760 A1 Mar. 29, 2012

(30) Foreign Application Priority Data

Mar. 4, 2009 (DE) ..... 10 2009 011 171

(51) Int. Cl.

| | |
|---|---|
| ***A46D 3/04*** | (2006.01) |
| ***A46D 3/05*** | (2006.01) |
| ***A46B 13/00*** | (2006.01) |

(52) U.S. Cl.

CPC ..... *A46B 13/001* (2013.01); *A46B 13/003* (2013.01); *A46D 3/04* (2013.01)

USPC ..... 300/21

(58) Field of Classification Search

USPC ..... 300/2, 21

See application file for complete search history.

(56) References Cited

U.S. PATENT DOCUMENTS

| | | | | |
|---|---|---|---|---|
| 2,860,921 | A | | 11/1958 | Clief, Jr. |
| 5,464,275 | A | * | 11/1995 | Altemare et al. ..... 300/21 |

FOREIGN PATENT DOCUMENTS

| | | |
|---|---|---|
| EP | 1 044 628 | 10/2000 |
| GB | 744 179 | 2/1956 |
| JP | 54 024460 | 2/1979 |

* cited by examiner

*Primary Examiner* — Randall Chin

(74) *Attorney, Agent, or Firm* — Cozen O'Connor

(57) ABSTRACT

A process for the production of a segment brush a half finished product is first produced, having a bristle fill bent at 90° arranged in a ring like form with a radially outwards pointing angular offset supported on a ring shoulder of a transfer device, seated with the second angular offset on a central arbor, axially moveable in the ring and axially protruding. A holding ring holds the first angular offset axially against the ring shoulder and the second angular offset radially against the arbor. Pressing of the bristle fill is made on the transfer device in a press against the holding ring. A pressing arbor firstly spreads the second angular offset of the bristle fill with an attachment, ejects the center arbor and presses the angular offsets against the ring shoulder of the ring.

7 Claims, 2 Drawing Sheets

METHOD FOR THE AUTOMATIC PRODUCTION OF A SEGMENT BRUSH AND ACCESSORY FOR CARRYING OUT THE METHOD

CROSS REFERENCE TO RELATED APPLICATIONS

This is a U.S. national stage of application No. PCT/DE2010/000072, filed on Jan. 26, 2010. Priority is claimed on German Application No. 10 2009 011 171.9 filed Mar. 4, 2009. The content of which is incorporated here by reference.

BACKGROUND OF THE INVENTION

1. Field of the Invention

The invention relates to a process for mechanical production of a segment brush and implements for the realization of the process, such as a transfer device and a press, as well as the segment brush itself.

2. Description of Related Art

Ring shaped brushes are common and proven in many different forms and designs. Ring brushes of greater axial length are frequently formed of combined segment brushes, for instance axially fixed on a hollow cylinder used for a bearing.

Such hollow brushes have a holding ring, around which a bristle fill is bent, whereby an internal radial, in a section somewhat U-formed, circumferential eyelet holds the bristle fill against the holding ring.

The mechanical production of such a segment brush is described for example in EP 1 044 628 B1.

The device disclosed in EP 1 044 628 B1 and that detailed for the mechanical production of a segment brush is not flexible in its application, exceedingly complex and solely serves the production of segment brushes with a internal radial eyelet.

If this eyelet could be spared, the segment brush would become more cost effective through material reduction and such segment brushes without eyelet can be combined to considerably denser ring brushes, as there is no spacing between the segment brushes as caused by the eyelet.

The production of such segment brushes without an eyelet however is to date only possible manually, whereby the wires are pre-bent and subsequently pressed.

SUMMARY OF THE INVENTION

One embodiment of the invention provides a process for mechanical production of a segment brush without eyelet and implements for the realization of this process.

This technical problem is solved by a process, in which a half finished product is first produced, in which a bristle fill bent at 90° arranged in a ring like form with a radially outwards pointing first angular offset supported on a ring shoulder of a ring of a transfer device, seated with the second angular offset on a central arbor, axially moveable in the ring and axially protruding therefrom, whereby a holding ring holds the first angular offset axially against the ring shoulder and the second angular offset radially against the arbor, consecutively pressing of the bristle fill is made on the transfer device in a press against the holding ring, whereby a pressing arbor firstly spreads the second angular offset of the bristle fill with an attachment, ejects the center arbor axially out of the second angular offset and presses with a ring shoulder the angular offsets with bordered holding ring against the ring shoulder of the ring.

The production of a bristle fill bent at 90° and arranged in a ring like form with holding ring can be conventionally made in a known machine. The transfer device with arbor can then be introduced into this, until the first angular offset is seated on the ring shoulder. Given matched dimension parameters such as the thickness of the bristle fill, the inner diameter of the holding ring, and the outer diameter of the arbor, this transfer device can transfer the bristle fill with holding ring, sufficiently securely seated on the transfer device, for example to an otherwise present press for pressing.

On pressing it has been proven advisable that a pressing arbor first spreads the second angular offset of the bristle fill with an attachment, whereby a radial outward bending direction is specified. When the pressing arbor, with its attachment, meets the central arbor then this is pushed out of the second angular offset of the bristle fill, and at the same time, being further bent until finally both angular offsets of the bristle fill with bordered holding ring are pressed between the ring shoulder of the ring and the ring shoulder of the pressing arbor.

As considerable forces are required for a permanent pressing, it is intended in further detail that the attachment of the pressing arbor is in sections immersed in an end-face recess in the central arbor, whereby preferably the pressing arbor is seated over the complete front face of the arbor.

In further detail of the process according to one embodiment of the invention the central arbor is returned to its initial position protruding from the ring shoulder of the ring by a device following pressing. Should pressing be made against the force of a spring, then this spring will return the central arbor of the transfer device to its initial position after retraction of the pressing arbor. Another alternative would be a cylinder with piston.

In mechanical production of a segment brush according to the invention a bristle fill of metal that can be permanently pressed is considered in the first instance. Synthetic materials however can also be used, in particular plastics. In the case of pressing a correspondingly warmed bristle fill, an adhesion of the bristles among another as well as an adhesion for example to a holding ring of plastic can be considered.

The production of the half finished product is made in a first machine and pressing in a second machine, separate from the first. In the second machine the completion of a brush is preferred, for example by trimming, fitting with brush parts or more of the like.

The transfer of the half finished product can also be made automatically, for instance by grippers, revolver arrangements, bowl or rod carrying chains, or the like.

The transfer device for the transfer of a half finished product of a segment brush can take a number of forms. The principle design is of a ring shoulder forming ring, in which a central, axially moveable arbor is intended for accepting the angular offsets of a 90° bent bristle fill of the segment brush.

In particular the opposite side of the transfer device to the taken, 90° bent bristle fill of the invention can to a great extent be freely designed in compliance with present equipment such as presses and their holders etc. Attention must be paid, however, that the central arbor is arranged to be fully moved in the ring.

In further detail the design intends, that the arbor in the bristle fill sided front face features a recess, the axial section of which at least in sections correlates to the attachment of a pressing arbor of a press. Hereby particular attention is due to having a form-fitting transfer from the central arbor to the attachment or rather the pressing arbor, so that the force of the press is applied over the complete section surface of the pressing arbor.

The second front face of the arbor can feature a cylindrical recess, so that the transfer device according to one embodiment of the invention can be set down on a pin, a tube or the like, for example for the transfer from a first to a second production machine.

In a further optional detail of the transfer device according to one embodiment of the invention the ring is sleeve like and features an adapter for fitting in the holder of a press. Adapter and holder are then optimally compatible with another.

If the ring is sleeve-like, a ring fast device is provided for returning the arbor moved during pressing back to its initial position, for example a pressure spring or a cylinder.

Should synthetic bristles be used according to the invention, it can be of advantage to apply heating, which can be by both arbor and ring fast. Such a heating source is generally operated electrically.

In many different respects requirements are to be made on the press for pressing the bristle fill with the holding ring, such as the generating of a comparatively high press force as well as ensuring an exact guiding on pressing, regarding the small surface to be pressed.

In particular on such a press it is intended that a holder is sleeve-like for accepting the arbor of a transfer device, as previously described, that a free axial length in the sleeve is sufficiently dimensioned for an axial movement of the arbor bon pressing and that a front border edge of the holder is formed as an abutment for the ring.

If such a holder is used, it is of advantage to provide this rather than the transfer device with a device for returning the arbor moved during pressing back to its initial position, whereby such a device can be a pressure spring or a cylinder. Likewise this holder will also feature a heating for pressing synthetic bristles.

BRIEF DESCRIPTION OF THE DRAWINGS

The invention is further detailed in the drawings, in which merely possible examples are shown schematically. The drawings show.

DETAILED DESCRIPTION OF THE PREFERRED EMBODIMENTS

Figure 1:
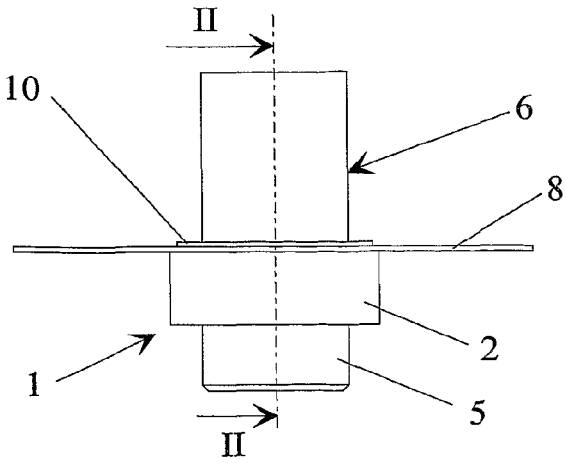
FIG. 1: a half finished product in side view.
Figure 2:
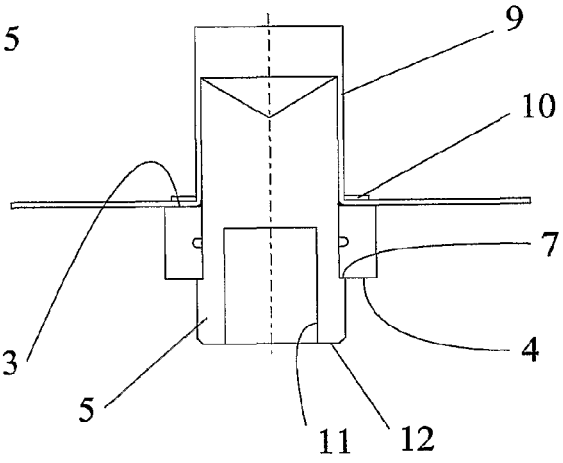
FIG. 2: cross section according to line II, II in FIG. 1.
Figure 3:
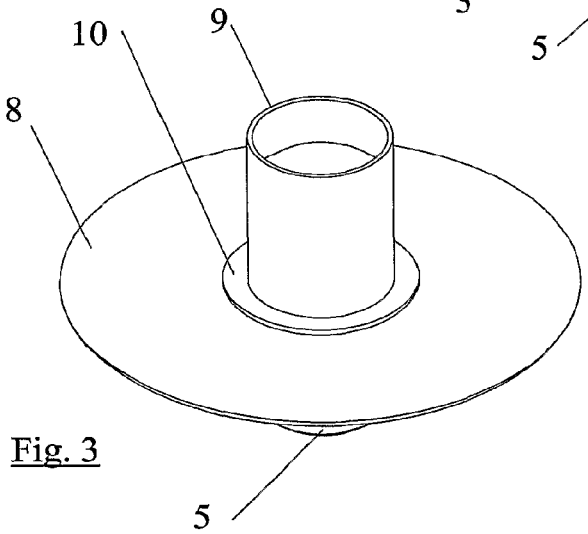
FIG. 3: an isometric view of the half finished product.

The transfer device 1 shown in FIGS. 1 to 3 is kept of simple design. The transfer device 1 features a ring 2, through which, vertical to the axial extent of the ring 2, two ring shoulders 3, 4 are formed on the front face. Within the ring 2 a central arbor 5 is axially moveable, however up to a 90° bent bristle fill 6 only up to the limit stop shown in FIG. 2 of an arbor fast ring shoulder 7 on the lower ring shoulder 4 of the ring 2. The 90° bent bristle fill 6 extends in a ring-like manner.

A first angular offset 8 of the ring-like 90° bent bristle fill 6 with radially outwards pointing bristles is seated on the upper ring shoulder 3 of the ring 2.

The second angular offset 9 of the bristle fill 6 extends in a ring-like form around the central arbor 5 and axially protruding therefrom.

A holding ring 10 holds the first angular offset 8 axially against the ring shoulder 3 of the ring 2 and the second angular offset radially against the arbor 5.

The production of the bristle fill 6 bent at 90° around the holding ring 10 can be made conventionally on a machine. The transfer device 1 is then brought into the machine, for example with a recess 11 in its front face 12 opposite from the bristle fill 6, seated on a piston.

After production of the half finished product shown in FIGS. 1 to 3 it can be transferred by the transfer device 1, for example with the recess 11 seating on a pin, tube or the like, to a second machine with a press for completion.

Figure 4:
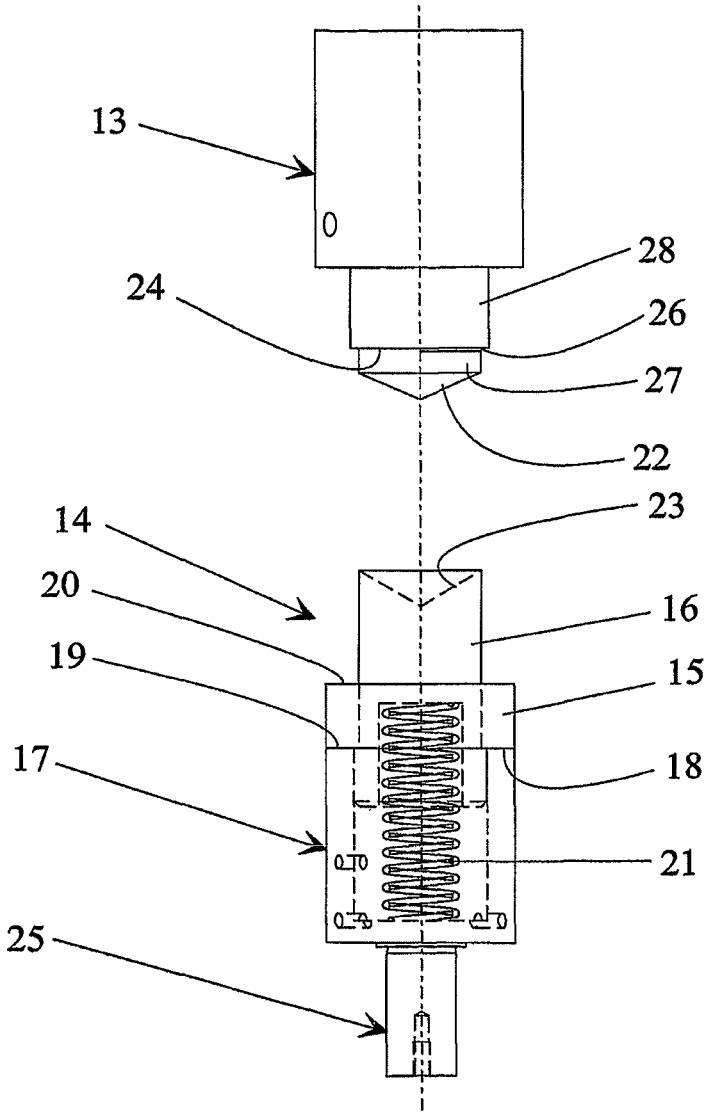
FIG. 4: a press arrangement.

FIG. 4 shows the arrangement of a pressing arbor 13 over a transfer device 14 with ring 15 and central arbor 16.

This arrangement features a sleeve-like holder 17, in which the arbor 16 is pushed so that the ring 15 with its lower ring shoulder 18 seats with its full surface on the front face border edge 19 of the holder 17.

The axial extent of the sleeve 17 is dimensioned, so that the central arbor 16 can be completely pushed under the upper ring shoulder 20 of the ring 15 against the force of a spring 21.

On pressing a pointed conical attachment 22 of the pressing arbor 13 spreads the bristle fill axially protruding of the arbor 16 and determines the radial direction for pressing. This conical attachment 22 then meets the central arbor 16 and is taken up in front faced recess 23, so that the pressing arbor 13 and the central arbor 16 form a locking connection.

As the pressing process continues the central arbor 16 is pushed into the sleeve like holder 17 against the force of the spring 21 and the bristle fill is pressed around the holding ring between a ring shoulder 24 of the pressing arbor 13 and the upper ring shoulder 20 of the ring 15, whereby the outer diameter of the ring shoulder 24 correlates to that of the ring shoulder 20.

To this end, both regarding the spreading of the bristle fill and the pressing thereof, a fillet 26 can be helpful, arranged in the crossover of a cylindrical cut 27 up to a cylinder 28, forming the ring shoulder 24, of the pressing arbor 13, in FIG. 4 merely indicated in the left half.

Once the pressing process is concluded and the pressing arbor 13 returned, the central arbor 16 is pushed back to the shown position, its initial position, by the force of the spring 21.

In a further embodiment the transfer device features a sleeve like ring, for example as shown in FIG. 4, formed by the ring 15 and the holder 17, and by an adapter, for example in the form of a pin 25 for fitting in a press sided holder.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A process for producing a segment brush, characterized by the production of a half finished product, comprising:

supporting a bristle fill bent at 90° arranged in a ring-like form with a radially outwards pointing first angular offset on a ring shoulder of a ring of a transfer device;

seating the bristle fill with a second angular offset on a central arbor axially moveable in the ring and axially protruding therefrom;

holding, by a holding ring, the first angular offset axially against the ring shoulder and the second angular offset radially against the central arbor;

pressing the bristle fill on the transfer device in a press against the holding ring;

spreading by a pressing arbor the second angular offset of the bristle fill with an attachment;

ejecting the central arbor axially out of the second angular offset; and pressing the first and second angular offsets and the holding ring against the ring shoulder of the ring.

2. The process according to claim 1, wherein the attachment of the pressing arbor is in sections in an end-face recess in the central arbor.

3. The process according to claim 1, wherein following pressing the first and second angular offsets and the holding ring against the ring shoulder of the ring, the central arbor is brought into its initial position by a device so that the central arbor protrudes from the ring shoulder of the ring.

4. The process according to claim 1, wherein at least the pressing the bristle fill on the transfer device is performed against a force of a spring.

5. The process according to claim 1, wherein a warmed bristle fill is pressed.

6. The process according to claim 1, wherein the production of the half finished product is in a first machine and at least the pressing the first and second angular offsets and the holding ring against the ring shoulder of the ring is in a second separate machine.

7. The process according to claim 6, wherein a transfer of the half finished product from the first machine to the second machine is done automatically.

* * * * *